US005378674A

United States Patent [19]

Kobayashi et al.

[11] Patent Number: 5,378,674

[45] Date of Patent: Jan. 3, 1995

[54] HEAT-SENSITIVE RECORDING MATERIAL

[75] Inventors: Norio Kobayashi; Toshiaki Takahashi; Masahiro Makino, all of Sabae; Masaaki Hosoda, Fukui, all of Japan

[73] Assignee: Nicca Chemical Co., Ltd., Fukui, Japan

[21] Appl. No.: 216,379

[22] Filed: Mar. 23, 1994

[30] Foreign Application Priority Data

Mar. 24, 1993 [JP] Japan ..... 5-089426

[51] Int. Cl.[6] ..... B41M 5/28

[52] U.S. Cl. ..... 503/208; 503/209; 503/213; 503/216; 503/225; 568/33

[58] Field of Search ..... 427/150; 503/208, 209, 503/213, 216, 225; 568/33

[56] References Cited

FOREIGN PATENT DOCUMENTS

| | | | |
|---|---|---|---|
| 56-127486 | 10/1981 | Japan | 503/216 |
| 61-50958 | 3/1986 | Japan | 428/480 |
| 63003991 | 6/1986 | Japan | 503/216 |
| 4-103386 | 7/1992 | Japan | 503/216 |
| 4-214389 | 12/1992 | Japan | 503/216 |
| 5050766 | 3/1993 | Japan | 503/216 |
| 5092665 | 4/1993 | Japan | 503/216 |

*Primary Examiner*—B. Hamilton Hess
*Attorney, Agent, or Firm*—Millen, White, Zelano & Branigan

[57] ABSTRACT

A heat-sensitive recording material comprises a heat-sensitive color forming layer which is formed on a supporter and contains a colorless or light color leuco dyestuff as a color forming substance, a developer which develops color of the leuco dyestuff by reaction with it when heated and a sensitizer. The developer is 2,4'-dihydroxydiphenylsulfone having purity of 97 weight % or more and prepared by washing and drying crystal which is obtained by dissolving crude 2,4'-dihydroxydiphenylsulfone in an alcohol having 1 to 4 carbon atoms or in a mixture of an alcohol having 1 to 4 carbon atoms and water by heating and then cooling the solution or partially removing the solvent from the solution by distillation. The heat-sensitive recording material has excellent properties, such as reduced fog and excellent image preservation (weatherability).

3 Claims, No Drawings

HEAT-SENSITIVE RECORDING MATERIAL

BACKGROUND OF THE INVENTION

1. Field of the Invention

The present invention relates to a novel heat-sensitive recording material. More particularly, it relates to a heat-sensitive recording material showing reduced fog and improved image preservation.

2. Description of the Related Art

Recently, heat-sensitive recording materials comprising a heat-sensitive color forming layer coated on a supporter, such as paper, synthetic paper, plastic film or the like, have widely been used in thermal printers of facsimiles, electronic calculators, microcomputers and the like, in thermo-pen recorders of cardiograph, analytical instruments and the like, as train tickets, POS labels in super markets and the like, and in the like other applications.

These heat-sensitive recording materials are generally produced by first preparing coating fluid, then coating the fluid on a supporter such as paper and drying to form a heat-sensitive color forming layer. For the preparation of the coating fluid, a colorless or light color leuco dyestuff of a lactone, a lactam, a spiropyran or the like as a color forming substance and a developer which develops color of the color forming substance by reaction with it when heated are separately pulverized with a ball mill or a sand mill and dispersed in a medium. The dispersions are mixed together with addition of a binder to prepare a coating fluid. Wax, sensitizers, surface active agents, defoaming agents, inorganic pigments and the like may be added to the mixed dispersion according to necessity.

As a developer showing good image preservation, 2,4'-dihydroxydiphenylsulfone or 4,4'-dihydroxydiphenylsulfone is used in Japanese Patent Application Laid-Open Nos. 1982-150599 and 1988-3991. However, these compounds show inferior heat response and sufficient color density cannot be obtained. To solve this problem, a sensitizer is generally added to the developer to lower the color forming temperature. Examples of the sensitizer currently used for such purpose are paraffin wax, amides, such as fatty acid amides, esters, such as dimethyl terephthalate, and ethers. However, these sensitizers often have drawbacks that they do not always provide sufficiently high color forming density, color forming sensitivity and reduced fog and that image preservation is poor to result in deterioration of the image with time even when an image of high density can be obtained. Thus, no sensitizer having satisfactory properties has heretofore been obtained.

SUMMARY OF THE INVENTION

The present invention accordingly has an object to eliminate the drawbacks of conventional heat-sensitive recording materials and provide a heat-sensitive recording material having excellent properties, such as reduced fog and excellent image preservation (weatherability).

Extensive investigations were undertaken by the present inventors to develop a heat-sensitive recording material having the excellent properties described above and it was discovered that the above object can be achieved by using as the developer 2,4'-dihydroxydiphenylsulfone prepared to purity of 97 weight % or more by washing and drying crystal which is obtained by dissolving crude 2,4'-dihydroxydiphenylsulfone in an alcohol having 1 to 4 carbon atoms or in a mixture of an alcohol having 1 to 4 carbon atoms and water by heating and then cooling the solution or partially removing the solvent from the solution by distillation. The object is achieved preferably by using a specific sensitizer additionally. The present invention has been completed on the basis of the discovery.

Thus, the heat-sensitive recording material comprises a heat-sensitive color forming layer which is formed on a supporter and contains a colorless or light color leuco dyestuff as a color forming substance, a developer which develops color of the leuco dyestuff by reaction with it when heated and a sensitizer, the developer being 2,4'-dihydroxydiphenylsulfone having purity of 97 weight % or more prepared by washing and drying crystal which is obtained by dissolving crude 2,4'-dihydroxydiphenylsulfone in an alcohol having 1 to 4 carbon atoms or in a mixture of an alcohol having 1 to 4 carbon atoms and water by heating and then cooling the solution or partially removing the solvent from the solution by distillation.

It is preferred that at least one kind selected from the group consisting of p-benzylbiphenyl, p-methylbenzyl oxalate, β-benzyloxynaphthalene, 1,2-di(m-methylphenoxy)ethane, m-terphenol, diphenylsulfone and phenyl 2,4,6-mesitylenesulfonate is used as the sensitizer contained in the color forming layer in the heat-sensitive recording material of the present invention.

Other and further objects, features and advantages of the invention will appear more fully from the following description.

DETAILED DESCRIPTION OF THE INVENTION

The present invention is described in detail in the following.

It is necessary that the color forming layer formed on a supporter in the heat-sensitive recording material of the present invention contains a color forming substance, 2,4'-dihydroxydiphenylsulfone having purity of 97 weight % or more obtained by a purification method using a specific alcohol solvent as a developer and a sensitizer.

In the present invention, 2,4'-dihydroxydiphenylsulfone having purity of 97 weight % or more. preferably 98 weight % or more, purified by using a solvent containing an alcohol having 1 to 4 carbon atoms is used.

A heat-sensitive recording material prepared by using 2,4'-dihydroxydiphenylsulfone having purity of less than 97 weight % obtained by the purification method of the present invention shows insufficient prevention of fog even though it shows improved fog and better image preservation than conventional heat-sensitive recording materials prepared by using 4,4'-dihydroxydiphenylsulfone or 4,4'-isopropylidenediphenyl. The 2,4'-dihydroxydiphenylsulfone having purity of 97 weight % or more prepared by washing and drying crystal which is obtained by dissolving crude 2,4'-dihydroxydiphenylsulfone in an alcohol having 1 to 4 carbon atoms or in a mixture of an alcohol having 1 to 4 carbon atoms and water by heating and then cooling the solution or partially removing the solvent by distillation from the solution remarkably reduces fog and improves image preservation of the heat-sensitive recording material when it is used in combination with a sensitizer. Thus, the effect of the present invention can be realized.

This effect is enhanced by increase in the purity obtained by the purification with the alcohol solvent. Thus, it is particularly preferred that 2,4'-dihydroxydiphenylsulfone having purity of 98 weight % or more is used even though yield of 2,4'-dihydroxydiphenylsulfone is decreased.

In the present invention, components having higher polarity which are considered to cause fog can be eliminated by using an alcohol having 1 to 4 carbon atoms. When an alcohol having more carbon atoms, a hydrocarbon solvent or an aromatic solvent is used, the effect of the present invention cannot be realized because it has a lower ability to dissolve 2,4'-dihydroxydiphenylsulfone to make it unsuitable for use or because it cannot eliminate components having higher polarity contained in small amounts and other impurities. Aromatic solvents have insufficient dissolving ability and are not suitable for use. On the contrary, acetone has an excessively large solubility, contains small amounts of polar substances and is not suitable for use because of a larger degree of fog.

As the alcohol having 1 to 4 carbon atones used in the present invention, methanol, ethanol, n-propanol, isopropanol, n-butanol, sec-butanol or tert-butanol can be used singly, as a mixture of two or more kinds thereof or as a mixture thereof with water in a desired proportion. Among them, methanol and isopropanol are particularly preferable because fog can be prevented more effectively and operation of drying by distillation for removal of the solvent is easier.

For adjusting the dissolving ability of the solvent, water is added to the alcohol solvent. Content of water is selected in the range of 0.1 to 99.9 weight % and preferably in the range of 30 to 70 weight %.

Kind of the colorless or light color leuco dyestuff used as the color forming substance in the heat-sensitive color forming layer comprised in the heat-sensitive recording material of the present invention is not particularly limited but can be selected according to desired from substances which are generally used as color forming substances in conventional heat-sensitive recording materials. Examples of the leuco dyestuff are: crystal violet lactone, malachite green lactone, 3,3-bis(p-dimethylaminophenyl)-6-aminophthalide, 3,3-bis(p-dimethylaminophenyl)-6-(p-toluenesulfonamide) phthalide, 3-dimethylamino-6-methyl-7-(o-chlorofluoran, 3-diethylamino-7-chlorofluoran, 3-diethylamino-7-(o-chloroanilino)fluoran, 3-diethylamino-7-(m-trifluoromethylanilino)-fluoran, 3-diethylamino-7-phenylfluoran, 3-diethylamino-7-dibenzylaminofluoran, 3-diethylamino-5-methyl-7-dibenzylaminofluoran, 3-diethylamino-6-methyl-7-anilinofluoran, 3 -diethylamino-6-methyl- 7-(o,p-dimethylanilino)fluoran, 3-diethylamino-7-(o-fluoroanilino)fluoran, 3-diethylamino-6-methyl-7-chlorofluoran, 3-diethylamino-6-methylfluoran, 3-diethylaminobenzo[a]fluoran, 3-dibutylamino-7-(o-chloroanilino)fluoran, 3-dibutylamino-6-methyl-7-anilinofluoran, 3-dibutylamino-7-fluoroanilinofluoran, 3-(N-methyl-N-propylamino)-6-methyl-7-anilinofluoran, 3-(N-ethyl-N-isobutylamino)-6-methyl-7-anilinofluoran, 3-cyclohexylamino-6-chlorofluoran, 3-pyrrolidino-6-methyl-7-anilinofluoran, 3-piperidino-6-methyl-7-anilinofluoran, 3-(N-ethyl-N-isoamylamino)-6-methyl-7-anilinofluoran, 3-(N-methyl-N-cyclohexylamino)-6-methyl-7 - anilinofluoran, 2-(N-methyl-N-phenyl amino )-6-(N-ethyl-N-p-toluidinoamino)fluoran, 3-(N-ethyl-N-p-toluidinoamino)-6-methyl-7-anilinofluoran, 3-(N-ethyl-N-tetrahydrofurfurylamino)-6-methyl-7-anilionfluoran, 1,3,3-trimethyl-6'-chloro-8'-methoxyindolinobenzspiropyran and the like. However, the leuco dyestuff is not limited to the compounds shown as examples. The color forming substance may be used singly or as a combination of two or more kinds. Amount of the color forming substance can be suitably selected depending on the developer used in combination.

As the sensitizer used in the present invention, the specific sensitizers described above are preferable. However, other sensitizers can be used together with the specific sensitizers according to desire in the range that the object of the present invention is not adversely affected. Examples of the other sensitizer are fatty acid amides, such as stearic acid amide, stearic acid methylolamide, oleic acid amide, palmitic acid amide, coconut fatty acid amide and the like; ethers, such as 1,2-bisphenoxylethane, 1,2-bisphenoxymethylbenzene, 1,2-bistolyloxymethylbenzene, 1,4-dimethoxynaphthalene, 1,4-dibenzyloxynaphthalene, benzyloxythiophenyl ether, 4-(p-tolyloxy)biphenyl, bisphenol S diallyl ether and the like; and esters, such as dibenzyl oxalate, dibenzyl terephthalate, phenyl 1-hydroxy-2-naphthoate, benzyl p-benzyloxy-benzoate and the like.

In the present invention, 4,4'-butylidene(6-t-butyl-3-methylphenol), 2,2'-di-t-butyl-5,5'-dimethyl-4,4'-sulfonylphenol, 1,1,3-tris(2-methyl-4-hydroxy-5-t-cyclohexylphenyl)butane, 1,1,3-tris(2-methyl-4-hydroxy-5-tbutylphenyl)butane, 1-[4'-(4''-benzyloxyphenylsulfonyl)phenoxy]-2,3-epoxypropane or the like may be added as an image stabilizer.

In the heat-sensitive recording material of the present invention, the heat-sensitive color forming layer can be formed by a conventional process. For example, a dispersion is prepared by dispersing the color forming substance, the developer and the sensitizer described above into a medium, such as an aqueous medium, together with a suitable binder, then coated on a supporter and dried. Examples of the binder are hydroxyethylcellulose, methylcellulose, carboxylmethylcellulose, polyvinyl alcohol, various kinds of modified polyvinyl alcohol, such as carboxy-modified polyvinyl alcohol, sulfonic acid-modified polyvinyl alcohol, silicone-modified polyvinyl alcohol, amide-modified polyvinyl alcohol and the like, gelatin, casein, starch, polyacrylic acid, polyacrylic acid esters, polyvinyl acetate, polyacrylamide, styrene-maleic acid copolymer, styrene-butadiene copolymer, polyamide resins, petroleum resins, terpene resins and the like. The binder may be used singly or as a combination of two or more kinds.

Examples of filler used in the present invention are inorganic fillers, such as silica, calcium carbonate, kaolin, calcined kaolin, diatomaceous earth, talc, titanium oxide, aluminum hydroxide and the like; and organic fillers, such as styrene microballs, nylon powder, ureaformaline resin filler and the like.

In addition to the ingredients described above, a lubricant, such as stearic acid ester wax, polyethylene wax, zinc stearate or the like, a benzophenone ultraviolet light absorbent, such as 2-hydroxy-4-benzyloxybenzophenone or the like, a triazole ultraviolet light absorbent, such as benzotriazole, 2-(2'-hydroxy-5'-methylphenyl)benzotriazole or the like, a water resistant agent, such as glyoxal or the like, a dispersant, a deforming agent and the like may be used.

The supporter used in the present invention is not particularly limited but a material generally used as a supporter in conventional heat-sensitive recording materials, such as paper, synthetic paper, plastic film or the like, may be used.

To summarize the advantages obtained by the invention, a heatsensitive recording material having excellent properties, such as reduced fog and excellent image preservation (weatherability), can be obtained according to the present invention.

The invention will be understood more readily with reference to the following examples; however, these examples are intended to illustrate the invention and are not to be construed to limit the scope of the invention.

Properties of the heat-sensitive recording material obtained in Examples and Comparative Examples were evaluated according to the following methods.

(1) Static Color Forming Property

Using a thermoingradient tester (a product of Toyo Seiki Seisakusho, Ltd.), color was formed at a sample pressure of 2 kg/cm$^2$, a heating time of 5 seconds and a color forming temperature of 105° C. and density of the image obtained was measured by Macbeth densitometer (RD-918 type, a product of Macbeth Co.).

(2) Dynamic Color Forming Property

Using a heat-sensitive printing apparatus (a product of Okura Denki Co., Ltd.; printing voltage, 20 V; pulse width, 3 ms), color was formed and density of the image obtained was measured by Macbeth densitometer.

(3) Resistance Against Plasticizer in Polyvinyl Chloride

An image formed by using a heat-sensitive printing apparatus (printing voltage, 20 V; pulse width, 3 ms) was put tightly on top of a polyvinyl chloride sheet and left standing at 45° C. for 24 hours under a load of 50 g/cm$^2$. Then, density of the image was measured by Macbeth densitometer to evaluate residual fraction of the density.

Synthesis Example 1

To 80 g of methanol, 120 g of water and 100 g of 2,4'-dihydroxydiphenylsulfone (purity, 75%) were added, dissolved into methanol by refiuxing and then cooled. Crystal obtained was washed with 40% methanol-water and dried to obtain 54 g of 2,4'-dihydroxydiphenylsulfone (purity, 97.5%).

Synthesis Example 2

To 100 g of isopropanol, 100 g of 2,4'-dihydroxydiphenylsulfone (purity, 80%) was added, dissolved into isopropanol by refluxing and then cooled. Crystal obtained was washed with isopropanol and dried to obtain 31 g of 2,4'-dihydroxydiphenylsulfone (purity, 99%).

Synthesis Example 3

To 90 g of methanol, 110 g of water and 100 g of 2,4'-dihydroxydiphenylsulfone (purity, 75%) were added, dissolved into methanol by refiuxing and then cooled. Crystal obtained was washed with 35% methanol-water and dried to obtain 49 g of 2,4'-dihydroxydiphenylsulfone (purity, 98%).

Synthesis Example 4

To 60 g of methanol, 140 g of water and 100 g of 2,4'-dihydroxydiphenylsulfone (purity, 75%) were added, dissolved into methanol by refluxing and then cooled. Crystal obtained was washed with 30% methanol-water and dried to obtain 82 g of 2,4'-dihydroxydiphenylsulfone (purity, 95%).

Example 1

For preparation of a coating fluid for formation of a heat-sensitive color forming layer, Dispersions A, B and C were prepared separately by pulverizing and dispersing the components shown in the following in a sand mill for 3 hours.

| | |
|---|---|
| Dispersion A (a dispersion of a color forming substance) | |
| 3-(N-methyl-N-cycylohexyl)amino-6-methyl-7-anilinofluoran | 2.0 weight parts |
| 10% aqueous solution of polyvinyl alcohol | 4.3 weight parts |
| water | 2.0 weight parts |
| Dispersion B (a dispersion of a developer) | |
| 2,4'-dihydroxydiphenylsulfone (purity, 99%) | 2.8 weight parts |
| 10% aqueous solution of polyvinyl alcohol | 12.0 weight parts |
| water | 5.2 weight parts |
| Dispersion C (a dispersion of a sensitizer) | |
| β-benzyloxynaphthalene | 2.8 weight parts |
| 10% aqueous solution of polyvinyl alcohol | 12.0 weight parts |
| water | 5.2 weight parts |
| Dispersion D was then prepared using Dispersions B and C. | |
| Dispersion D | |
| Dispersion B | 3.0 weight parts |
| Dispersion C | 3.0 weight parts |
| 10% aqueous solution of polyvinyl alcohol | 8.0 weight parts |
| kaolin | 0.61 weight parts |

Then, 0.58 weight parts of Dispersion A and 10 weight parts of Dispersion D were mixed to prepare a coating fluid for forming a heat-sensitive color forming layer. The coating fluid was coated on a wood free paper of 65 g/m$^2$ basis weight in an amount to form a dried coating of about 6 g/m$^2$ and air-dried to obtain a heat-sensitive recording paper. Result of the evaluation of this heat-sensitive recording paper is shown in Table 1.

Example 2

A heat-sensitive recording paper was obtained by the same method as that in Example 1 except that 2,4'-dihydroxydiphenylsulfone (purity, 98%) was used for Dispersion B in place of 2,4'-dihydroxydiphenylsulfone (purity, 99%) used in Example 1. Result of the evaluation of this heat-sensitive recording paper is shown in Table 1.

Example 3

A heat-sensitive recording paper was obtained by the same method as that in Example 1 except that 2,4'-dihydroxydiphenylsulfone (purity, 97.5%) was used for Dispersion B in place of 2,4'-dihydroxydiphenylsulfone (purity, 99%) used in Example 1. Result of the evaluation of this heat-sensitive recording paper is shown in Table 1.

Comparative Example 1

A heat-sensitive recording paper for comparison was obtained by the same method as that in Example 1 except that 2,4'-dihydroxydiphenylsulfone (purity, 95%) was used for Dispersion B in place of 2,4'-dihydroxydiphenylsulfone (purity, 99%) used in Example 1. Result of the evaluation of this heat-sensitive recording paper is shown in Table 1.

Example 4

A heat-sensitive recording paper was obtained by the same method as that in Example 1 except that di(p-methylbenzyl) oxalate was used for Dispersion C in place of β-benzyloxynaphthalene used in Example 1. Result of the evaluation of this heat-sensitive recording paper is shown in Table 1.

Example 5

A heat-sensitive recording paper was obtained by the same method as that in Example 4 except that 2,4'-dihydroxydiphenylsulfone (purity, 98%) was used for Dispersion B in place of 2,4'-dihydroxydiphenylsulfone (purity, 99%) used in Example 4. Result of the evaluation of this heat-sensitive recording paper is shown in Table 1.

Example 6

A heat-sensitive recording paper was obtained by the same method as that in Example 4 except that 2,4'-dihydroxydiphenylsulfone (purity, 97.5%) was used for Dispersion B in place of 2,4'-dihydroxydiphenylsulfone (purity, 99%) used in Example 4. Result of the evaluation of this heat-sensitive recording paper is shown in Table 1.

Comparative Example 2

A heat-sensitive recording paper for comparison was obtained by the same method as that in Example 4 except that 2,4'-dihydroxydiphenylsulfone (purity, 95%) was used for Dispersion B in place of 2,4'-dihydroxydiphenylsulfone (purity, 99%) used in Example 4. Result of the evaluation of this heat-sensitive recording paper is shown in Table 1.

Example 7

A heat-sensitive recording paper was obtained by the same method as that in Example 1 except that 1,2-di(m-methylphenoxy)ethane was used for Dispersion C in place of β-benzyloxynaphthalene used in Example 1. Result of the evaluation of this heat-sensitive recording paper is shown in Table 1.

Example 8

A heat-sensitive recording paper was obtained by the same method as that in Example 7 except that 2,4'-dihydroxydiphenylsulfone (purity, 98%) was used for Dispersion B in place of 2,4'-dihydroxydiphenylsulfone (purity, 99%) used in Example 7. Result of the evaluation of this heat-sensitive recording paper is shown in Table 1.

Example 9

A heat-sensitive recording paper was obtained by the same method as that in Example 7 except that 2,4'-dihydroxydiphenylsulfone (purity, 97.5%) was used for Dispersion B in place of 2,4'-dihydroxydiphenylsulfone (purity, 99%) used in Example 7. Result of the evaluation of this heat-sensitive recording paper is shown in Table 1.

Comparative Example 3

A heat-sensitive recording paper for comparison was obtained by the same method as that in Example 7 except that 2,4'-dihydroxydiphenylsulfone (purity, 95%) was used for Dispersion B in place of 2,4'-dihydroxydiphenylsulfone (purity, 99%) used in Example 7. Result of the evaluation of this heat-sensitive recording paper is shown in Table 1.

Example 10

A heat-sensitive recording paper was obtained by the same method as that in Example 1 except that p-benzylbiphenyl was used for Dispersion C in place of β-benzyloxynaphthalene used in Example 1. Result of the evaluation of this heat-sensitive recording paper is shown in Table 1.

Example 11

A heat-sensitive recording paper was obtained by the same method as that in Example 10 except that 2,4'-dihydroxydiphenylsulfone (purity, 98%) was used for Dispersion B in place of 2,4'-dihydroxydiphenylsulfone (purity, 99%) used in Example 10. Result of the evaluation of this heat-sensitive recording paper is shown in Table 1.

Example 12

A heat-sensitive recording paper was obtained by the same method as that in Example 10 except that 2,4'-dihydroxydiphenylsulfone (purity, 97.5%) was used for Dispersion B in place of 2,4'-dihydroxydiphenylsulfone (purity, 99%) used in Example 10. Result of the evaluation of this heat-sensitive recording paper is shown in Table 1.

Comparative Example 4

A heat-sensitive recording paper for comparison was obtained by the same method as that in Example 10 except that 2,4'-dihydroxydiphenylsulfone (purity, 95%) was used for Dispersion B in place of 2,4'-dihydroxydiphenylsulfone (purity, 99%) used in Example 10. Result of the evaluation of this heat-sensitive recording paper is shown in Table 1.

Example 13

A heat-sensitive recording paper was obtained by the same method as that in Example 1 except that m-terphenyl was used for Dispersion C in place of β-benzyloxynaphthalene used in Example 1. Result of the evaluation of this heat-sensitive recording paper is shown in Table 1.

Example 14

A heat-sensitive recording paper was obtained by the same method as that in Example 13 except that 2,4'-dihydroxydiphenylsulfone (purity, 98%) was used for Dispersion B in place of 2,4'-dihydroxydiphenylsulfone (purity, 99%) used in Example 13. Result of the evaluation of this heat-sensitive recording paper is shown in Table 1.

Example 15

A heat-sensitive recording paper was obtained by the same method as that in Example 13 except that 2,4'-dihydroxydiphenylsulfone (purity, 97.5%) was used for Dispersion B in place of 2,4'-dihydroxydiphenylsulfone (purity, 99%) used in Example 13. Result of the evaluation of this heat-sensitive recording paper is shown in Table 1.

Comparative Example 5

A heat-sensitive recording paper for comparison was obtained by the same method as that in Example 13 except that 2,4'-dihydroxydiphenylsulfone (purity, 95%) was used for Dispersion B in place of 2,4'-dihydroxydiphenylsulfone (purity, 99%) used in Example 13. Result of the evaluation of this heat-sensitive recording paper is shown in Table 1.

Example 16

A heat-sensitive recording paper was obtained by the same method as that in Example 1 except that diphenylsulfone was used for Dispersion C in place of β-benzyloxynaphthalene used in Example 1. Result of the evaluation of this heat-sensitive recording paper is shown in Table 1.

Example 17

A heat-sensitive recording paper was obtained by the same method as that in Example 16 except that 2,4'-dihydroxydiphenylsulfone (purity, 98%) was used for Dispersion B in place of 2,4'-dihydroxydiphenylsulfone (purity, 99%) used in Example 16. Result of the evaluation of this heat-sensitive recording paper is shown in Table 1.

Example 18

A heat-sensitive recording paper was obtained by the same method as that in Example 16 except that 2,4'-dihydroxydiphenylsulfone (purity, 97.5%) was used for Dispersion B in place of 2,4'-dihydroxydiphenylsulfone (purity, 99%) used in Example 16. Result of the evaluation of this heat-sensitive recording paper is shown in Table 1.

Comparative Example 6

A heat-sensitive recording paper for comparison was obtained by the same method as that in Example 16 except that 2,4'-dihydroxydiphenylsulfone (purity, 95%) was used for Dispersion B in place of 2,4'-dihydroxydiphenylsulfone (purity, 99%) used in Example 16. Result of the evaluation of this heat-sensitive recording paper is shown in Table 1.

Example 19

A heat-sensitive recording paper was obtained by the same method as that in Example 1 except that phenyl 2,4,6-mesitylenesulfonate was used for Dispersion C in place of β-benzyloxynaphthalene used in Example 1. Result of the evaluation of this heat-sensitive recording paper is shown in Table 1.

Example 20

A heat-sensitive recording paper was obtained by the same method as that in Example 19 except that 2,4'-dihydroxydiphenylsulfone (purity, 98%) was used for Dispersion B in place of 2,4'-dihydroxydiphenylsulfone (purity, 99%) used in Example 19. Result of the evaluation of this heat-sensitive recording paper is shown in Table 1.

Example 21

A heat-sensitive recording paper was obtained by the same method as that in Example 19 except that 2,4'-dihydroxydiphenylsulfone (purity, 97.5%) was used for Dispersion B in place of 2,4'-dihydroxydiphenylsulfone (purity, 99%) used in Example 19. Result of the evaluation of this heat-sensitive recording paper is shown in Table 1.

Comparative Example 7

A heat-sensitive recording paper for comparison was obtained by the same method as that in Example 19 except that 2,4'-dihydroxydiphenylsulfone (purity, 95%) was used for Dispersion B in place of 2,4'-dihydroxydiphenylsulfone (purity, 99%) used in Example 19. Result of the evaluation of this heat-sensitive recording paper is shown in Table 1.

TABLE 1

| | sensitizer | purity of 2,4'-dihydroxydiphenylsulfone | fog | resistance against plasticizer in polyvinyl chloride |
|---|---|---|---|---|
| Example 1 | β-benzyloxynaphthalene | 99.0 | 0.07 | 101 |
| Example 2 | | 98.0 | 0.07 | 100 |
| Example 3 | | 97.5 | 0.08 | 100 |
| Comparative Example 1 | | 95.0 | 0.10 | 101 |
| Example 4 | di(p-methylbenzyl) oxalate | 99.0 | 0.08 | 98 |
| Example 5 | | 98.0 | 0.08 | 97 |
| Example 6 | | 97.5 | 0.08 | 96 |
| Comparative Example 2 | | 95.0 | 0.10 | 94 |
| Example 7 | 1,2-di(m-methylphenoxy)ethane | 99.0 | 0.07 | 99 |
| Example 8 | | 98.0 | 0.07 | 99 |
| Example 9 | | 97.5 | 0.08 | 97 |
| Comparative Example 3 | | 95.0 | 0.09 | 93 |
| Example 10 | p-benzylbiphenyl | 99.0 | 0.06 | 98 |
| Example 11 | | 98.0 | 0.06 | 98 |
| Example 12 | | 97.5 | 0.07 | 97 |
| Comparative Example 4 | | 95.0 | 0.10 | 91 |
| Example 13 | m-terphenyl | 99.0 | 0.08 | 101 |
| Example 14 | | 98.0 | 0.08 | 100 |
| Example 15 | | 97.5 | 0.08 | 98 |
| Comparative Example 5 | | 95.0 | 0.10 | 93 |
| Example 16 | diphenylsulfone | 99.0 | 0.08 | 101 |
| Example 17 | | 98.0 | 0.08 | 100 |
| Example 18 | | 97.5 | 0.08 | 97 |
| Comparative Example 6 | | 95.0 | 0.10 | 92 |
| Example 19 | phenyl 2,4,6-mesitylenesulfonate | 99.0 | 0.07 | 100 |
| Example 20 | | 98.0 | 0.07 | 100 |
| Example 21 | | 97.5 | 0.08 | 99 |
| Comparative Example 7 | | 95.0 | 0.11 | 94 |

While the invention has been particularly shown and described with reference to preferred embodiments thereof, it will be understood by those skilled in the art that the foregoing and other changes in form and details can be made therein without departing from the spirit and scope of the invention.

What is claimed is:

1. A heat-sensitive recording material comprising a heat-sensitive color forming layer which is formed on a supporter and contains a colorless or light color leuco dyestuff as a color forming substance, a developer which develops color of the leuco dyestuff by reaction with it when heated and a sensitizer, the developer being 2,4'-dihydroxydiphenylsulfone having purity of 97 weight % or more prepared by washing and drying crystal which is obtained by dissolving crude 2,4'-dihydroxydiphenylsulfone in an alcohol having 1 to 4 carbon atoms or in a mixture of an alcohol having 1 to 4 carbon atoms and water by heating and then cooling the solution or partially removing the solvent from the solution by distillation.

2. A heat-sensitive recording material as claimed in claim 1, wherein the alcohol having 1 to 4 carbon atoms is methanol or isopropanol.

3. A heat-sensitive recording material as claimed in claim 1, wherein the sensitizer contained in the color forming layer is at least one kind selected from the group consisting of p-benzylbiphenyl, p-methylbenzyl oxalate, β-benzyloxynaphthalene, 1,2-di(m-methylphenoxy)ethane, m-terphenol, diphenylsulfone and phenyl 2,4,6-mesitylenesulfonate.

* * * * *